US011053765B2

(12) United States Patent
Luca et al.

(10) Patent No.: US 11,053,765 B2
(45) Date of Patent: Jul. 6, 2021

(54) AUTOMATIC WELL CONTROL

(71) Applicant: Ensco International Incorporated, Wilmington, DE (US)

(72) Inventors: Gilles Luca, Katy, TX (US); Ala Eddine Omrani, Houston, TX (US); Christopher Morris Johnston, Beach City, TX (US)

(73) Assignee: Ensco International Incorporated, Wilmington, DE (US)

( * ) Notice: Subject to any disclaimer, the term of this patent is extended or adjusted under 35 U.S.C. 154(b) by 29 days.

(21) Appl. No.: 16/178,145

(22) Filed: Nov. 1, 2018

(65) Prior Publication Data

US 2019/0128086 A1 May 2, 2019

Related U.S. Application Data

(60) Provisional application No. 62/580,412, filed on Nov. 1, 2017.

(51) Int. Cl.

| | |
|---|---|
| ***E21B 33/06*** | (2006.01) |
| ***E21B 47/06*** | (2012.01) |
| ***E21B 21/08*** | (2006.01) |
| ***E21B 47/10*** | (2012.01) |
| ***E21B 33/064*** | (2006.01) |
| ***E21B 34/16*** | (2006.01) |

(52) U.S. Cl.

CPC ..... *E21B 33/063* (2013.01); *E21B 21/08* (2013.01); *E21B 33/064* (2013.01); *E21B 34/16* (2013.01); *E21B 47/06* (2013.01); *E21B 47/10* (2013.01)

(58) Field of Classification Search

CPC ..... E21B 33/063; E21B 33/064; E21B 34/16; E21B 21/08; E21B 47/10; E21B 47/06

See application file for complete search history.

(56) References Cited

U.S. PATENT DOCUMENTS

| | | | | |
|---|---|---|---|---|
| 5,006,845 | A * | 4/1991 | Calcar | E21B 47/001 367/81 |
| 2012/0274475 | A1 | 11/2012 | Milne et al. | |
| 2016/0130905 | A1 | 5/2016 | Holmes et al. | |
| 2017/0089163 | A1 | 3/2017 | Vitou | |
| 2019/0211652 | A1 * | 7/2019 | Camp | E21B 41/0092 |

OTHER PUBLICATIONS

International Application No. PCT/US2018/058735, Transmittal of the International Search Report and Written Opinion, dated Feb. 13, 2019, 17 pgs.

* cited by examiner

*Primary Examiner* — Giovanna Wright
*Assistant Examiner* — Yanick A Akaragwe
(74) *Attorney, Agent, or Firm* — Fletcher Yoder, P.C.

(57) ABSTRACT

A system, includes a first sensor configured to monitor a first characteristic of drilling fluid and generate a first indication based on the monitoring. The system also includes a second sensor configured to monitor a second characteristic of drilling fluid and generate a second indication based on the monitoring. The system further includes a processor configured to correlate the first indication with the second indication to generate a baseline value indicative of a characteristic of a well.

19 Claims, 4 Drawing Sheets

AUTOMATIC WELL CONTROL

CROSS REFERENCE TO RELATED APPLICATIONS

This application is a Non-Provisional Application claiming priority to U.S. Provisional Patent Application No. 62/580,412, entitled "Automatic Well Control", filed Nov. 1, 2017, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. However, as wells are drilled at increasing depths, additional components may be utilized to, for example, control and or maintain pressure at the wellbore (e.g., the hole that forms the well) and/or to prevent or direct the flow of fluids into and out of the wellbore. One component that may be utilized to accomplish this control and/or direction of fluids into and out of the wellbore is a blowout preventer (BOP).

The BOP may include, for example, one or more annular BOPs and/or one or more ram BOPs. The ram BOPs may operate to seal a wellbore by, for example, fully covering the wellbore or by sealing a bore area around a drill pipe extending into the wellbore. The ram BOPs may include shear rams that operate to shear through drill pipe to, for example, regain pressure control over a wellbore. However, activation of a BOP as a well control response cause significant downtime for the drilling operation.

DETAILED DESCRIPTION

Figure 1:
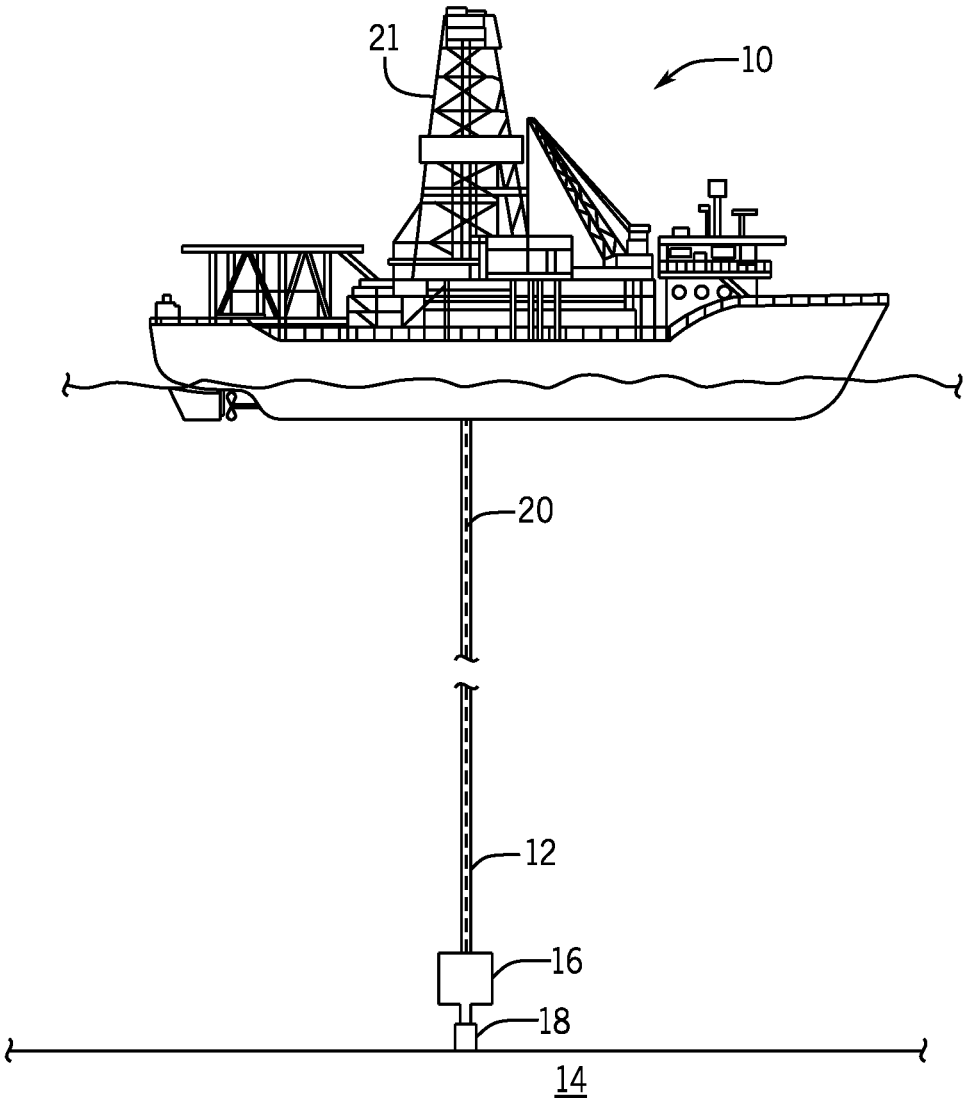
FIG. 1 illustrates an example of an offshore platform having a riser coupled to a blowout preventer (BOP), in accordance with an embodiment.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Systems and techniques for monitoring for improved well control and/or implementing automatic well controls are set forth below. Typically, BOPs are able to contain well kicks (e.g., pressures within drilled rock are higher than the mud pressure acting on the borehole or rock face such that fluids are forced into the wellbore) as a blowout prevention technique. However, such containment can be disruptive to drilling schedules, can lead to increased downtime, and may have additional adverse effects. Accordingly, monitoring for conditions that precede well events, such as influx into a wellbore, and/or well control systems and techniques that operate based on the monitored conditions may reduce the disruption due to containment by the BOP, for example, controlling the well before a well kick occurs.

A closed loop process based on managed pressures in a closed loop system may be implemented to monitor for precursor events to a well kick. However, the vast majority of well control systems do not utilize a closed loop system and instead are open ended to the atmosphere. Accordingly, additional techniques may be utilized that do not require monitoring of managed pressures in a closed loop system. For example, monitoring for early detection of influx into a wellbore may be undertaken utilizing one or more inputs each available on a rig. One of the inputs may be an indication of a drilling fluid (mud) pump output (e.g., the volume of mud being transmitted into the well). A second input may be the pressure of the drilling fluid transmitted into the well. In one embodiment, monitoring of the relationship between the drilling fluid volume and pressure can be undertaken and can establish a normal range of values that correspond to volume and pressure inputs of the drilling fluid. If this range is exceeded (e.g., if the relationship between the volume and the pressure of the drilling fluid changes), this can be indicative of the beginning of an influx of, for example, fluid into the wellbore. Similarly, one or more thresholds within the determined normal range can be set and if one or more of the thresholds are exceeded, indications of the occurrence and/or automatic closing of the well can be undertaken by transmission of a control signal to the BOP.

With the foregoing in mind, FIG. 1 illustrates an offshore platform 10 as a drillship. Although the presently illustrated embodiment of an offshore platform 10 is a drillship (e.g., a ship equipped with a drilling system and engaged in offshore oil and gas exploration and/or well maintenance or completion work including, but not limited to, casing and tubing installation, subsea tree installations, and well capping), other offshore platforms 10 such as a semi-submersible platform, a jack up drilling platform, a spar platform, a floating production system, or the like may be substituted for the drillship. Indeed, while the techniques and systems described below are described in conjunction with a drillship, the techniques and systems are intended to cover at least the additional offshore platforms 10 described above. Likewise, while an offshore platform 10 is illustrated and described in FIG. 1, the techniques and systems described herein may also be applied to and utilized in onshore (e.g., land based) drilling activities. These techniques may also apply to at least vertical drilling or production operations (e.g., having a rig in a primarily vertical orientation drill or produce from a substantially vertical well) and/or directional drilling or production operations (e.g., having a rig in a primarily vertical orientation drill or produce from a substantially non-vertical or slanted well or having the rig oriented at an angle from a vertical alignment to drill or produce from a substantially non-vertical or slanted well).

As illustrated in FIG. 1, the offshore platform 10 includes a riser string 12 extending therefrom. The riser string 12 may include a pipe or a series of pipes that connect the offshore platform 10 to the seafloor 14 via, for example, a BOP 16 that is coupled to a wellhead 18 on the seafloor 14. In some embodiments, the riser string 12 may transport produced hydrocarbons and/or production materials between the offshore platform 10 and the wellhead 18, while the BOP 16 may include at least one BOP stack having at least one valve with a sealing element to control wellbore fluid flows. In some embodiments, the riser string 12 may pass through an opening (e.g., a moonpool) in the offshore platform 10 and may be coupled to drilling equipment of the offshore platform 10. As illustrated in FIG. 1, it may be desirable to have the riser string 12 positioned in a vertical orientation between the wellhead 18 and the offshore platform 10 to allow a drill string made up of drill pipes 20 to pass from the offshore platform 10 through the BOP 16 and the wellhead 18 and into a wellbore below the wellhead 18. Also illustrated in FIG. 1 is a drilling rig 21 (e.g., a drilling package or the like) that may be utilized in the drilling and/or servicing of a wellbore below the wellhead 18.

Figure 2B:
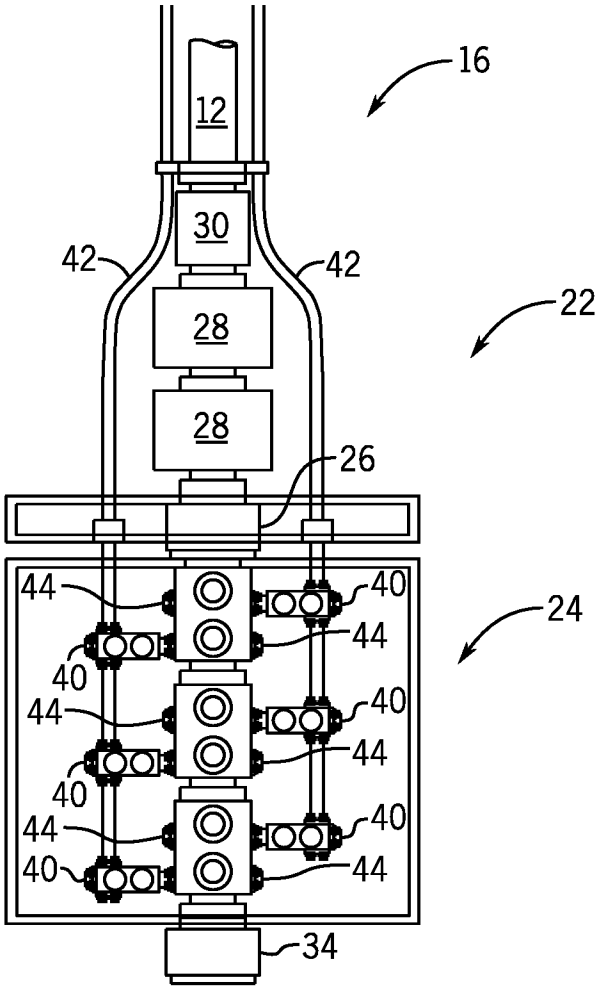
FIG. 2B illustrates a front view of the BOP of FIG. 1, in accordance with an embodiment.
Figure 2A:
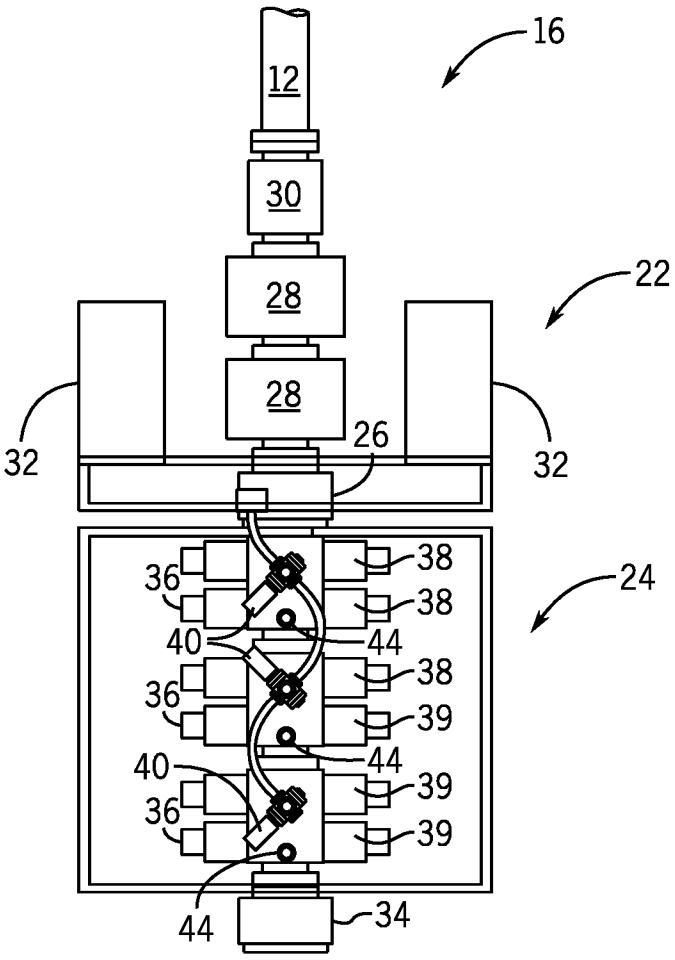
FIG. 2A illustrates a side view of the BOP of FIG. 1, in accordance with an embodiment.

FIGS. 2A and 2B illustrate a side view and a front view, respectively, of the BOP 16 of FIG. 1. As illustrated, the BOP 16 may include an upper BOP stack 22 and a lower BOP stack 24 that may operate either independently or in combination to control fluid flow into and out of a wellhead. The upper BOP stack 22 may be a lower marine riser package that includes a riser connector 26 that allows for fluid connection between the riser 12 and the lower BOP stack 24 and one or more annular BOPs 28 that may consist of a large valve used to control wellbore fluids through mechanical squeezing of a sealing element about the drill pipe 20. The upper BOP stack 22 may also include a ball/flex joint 30 that allows for angular movement of the riser 12 with respect to the BOP 16, for example, allowing for movement of the riser 12 due to movement of the offshore platform 10. Furthermore, the upper BOP stack 22 may include at least one control 32 (e.g., a BOP control pod) that operates as an interface between control lines that supply hydraulic and electric power and signals from the offshore platform 10 and the BOP 16 and/or other subsea equipment to be monitored and controlled (including the BOP 16). The control 32 and its additional functionality will be discussed in greater detail with respect to FIG. 3.

As previously noted, the BOP 16 also includes a lower BOP stack 24. The lower BOP stack 24 may be coupled to wellhead 18 via a wellhead connector 34. Furthermore, the lower BOP stack 24 may include one or more ram preventers 36. Each ram preventer 36 may include a set of opposing rams that are designed to close within a bore (e.g., a center aperture region about drill pipe 20) of the BOP 16, for example, through hydraulic operation. The ram preventers 36 may be single-ram preventers (having one pair of opposing rams), double-ram preventers (having two pairs of opposing rams), triple-ram preventers (having three pairs of opposing rams), quad-ram ram preventers (having four pairs of opposing rams), or may include additional configurations. As illustrated, the ram preventers 36 of FIGS. 2A and 2B are double-ram preventers.

Each of the ram preventers 36 may include cavities through which the respective opposing rams may pass into the bore of the BOP 16. These cavities may include, for example, shear ram cavities 38 that house shear rams (e.g., hardened tool steel blades designed to cut/shear the drill pipe 20 then fully close to provide isolation or sealing of the wellbore). The ram preventers 36 may also include, for example, pipe ram cavities 39 that house pipe rams (e.g., horizontally opposed sealing elements with a half-circle holes therein that mate to form a sealed aperture of a certain size through which drill pipe 20 passes) or variable bore rams (e.g., horizontally opposed sealing elements with a half-circle holes therein that mate to form a variably sized sealed aperture through which a wider range of drill pipes 20 may pass).

The lower BOP stack 24 may further include failsafe valves 40. These failsafe valves 40 may include, for example, choke valves and kill valves that may be used to control the flow of well fluids being produced by regulating high pressure fluids passing through the conduits 42 arranged laterally along the riser 12 to allow for control of the well pressure. The ram preventers 36 may include vertically disposed side outlets 44 that allow for the failsafe valves 40 to be coupled to the BOP 16.

Figure 3:
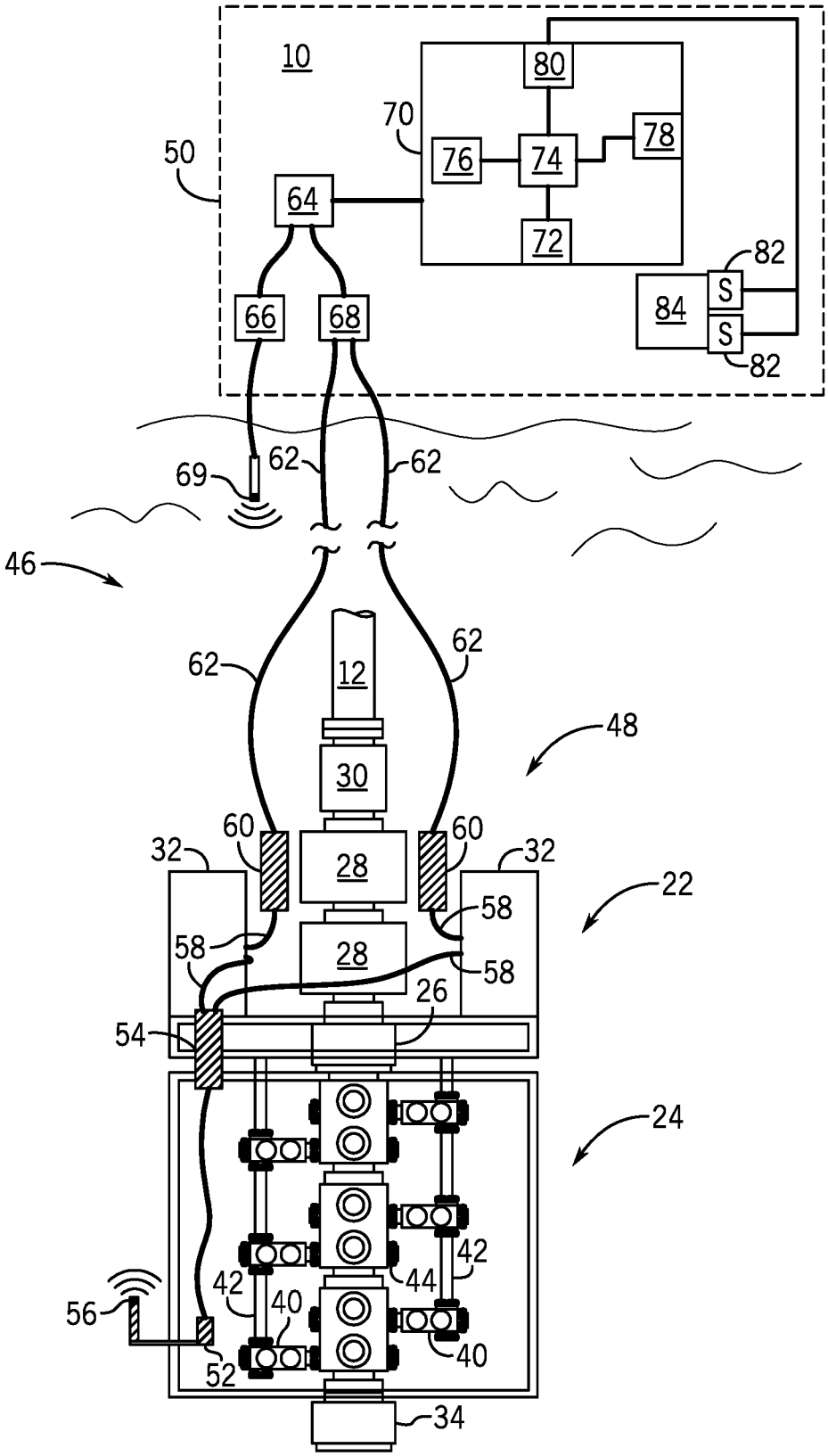
FIG. 3 illustrates a front view of a control system of the BOP of FIG. 1, in accordance with an embodiment.

FIG. 3 illustrates a control system 46 that may include a subsea control system 48 and a surface control system 50 for use with the BOP 16. The subsea control system 48 may include the control 32. In some embodiments, the control 32 may operate to transmit control signals to the BOP 16 to control operation of the BOP. Similarly, the control 32 may operate to receive one or more signals (e.g., operational indications or the like) from the BOP 16 and transmit those signals to the offshore platform 10. For example, control 32 may route the signals it generates to an acoustic communication system 52 via an electrical junction 54. The acoustic communication system 52 may include an acoustic beacon 56 that may transmit an indication of any signals transmitted thereto (e.g., from the BOP 16 and/or from the control 32). In other embodiments, other wireless transceivers or transmitters separate from the acoustic communication system 52 may be utilized in place of or in addition to the acoustic communication system 52 to transmit indications from the BOP 16 and/or the control 32 to the offshore platform 10.

One or more electrical connecters 58 may additionally be present and in one embodiment, an electrical connector may be coupled to junction box 60 to transmit indications between the control 32 and the offshore platform 10, for example, via control umbilicals 62 or through a dedicated umbilical deployed along the riser 12. The control 32 may receive signals indicative of whether to initiate a shut in the BOP 16 through activation of one or more of the ram preventers 36 (e.g., from the offshore platform 10). Additionally, the control 32 may operate to activate one or more of the ram preventers 36, for example, when communication, electrical, and/or hydraulic lines are disrupted. Additionally and/or alternatively, control of activation of the ram preventers 36 may be accomplished using the surface control system 50.

The surface control system 50 may include an interface junction 64. The interface junction 64 may receive signals from acoustic junction box 66 and a surface BOP control system 68 (and/or from a dedicated umbilical deployed along the riser 12). The acoustic junction box 66 may receive signals from an acoustic beacon 69. The signals received by the acoustic beacon 69 may be communications with acoustic beacon 56 and may be forwarded from the acoustic beacon 69 to the acoustic junction box 66 and to the interface junction 64. In other embodiments, other wireless transceivers or receivers separate from the acoustic beacon 69 may be utilized in place of or in addition to the acoustic beacon 69 and the acoustic junction box 66.

The surface BOP control system 68 may operate to transmit indications to the control 32 to activate the BOP 16 (e.g., shut in the well). Additionally, the surface BOP control system 68 may receive indications of from the control 32 regarding, for example, operational characteristics of the BOP 16. The surface BOP control system 68 may forward these signals to the interface junction 64. Similarly, the interface junction 64 may transmit signals received from the acoustic junction box 66 and the surface BOP control system 68 to the computing system 70.

In some embodiments, the computing system 70 may be communicatively coupled to a separate main control system, for example, a control system in a driller's cabin that may provide a centralized control system for drilling controls, automated pipe handling controls, BOP controls, and the like. In other embodiments, the computing system 70 may be a portion of the main control system (e.g., the control system present in the driller's cabin). It should be noted that the computing system 70 of offshore platform 10 may operate in conjunction with software systems implemented as computer executable instructions stored in a non-transitory machine readable medium of computing system 70, such as memory 72, a hard disk drive, or other short term and/or long term storage and may be executed, for example, by one or more processors 74 or a controller of computing system 70. Accordingly, computing system 70 may include an application specific integrated circuit (ASIC), one or more processors 74, or another processing device that interacts with one or more tangible, non-transitory, machine-readable media of computing system 70 that collectively stores instructions executable by the controller the method and actions described herein. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by the processor 74 or by any general purpose or special purpose computer or other machine with a processor 74.

Thus, the computing system 70 may include a processor 74 that may be operably coupled with the memory 72 to perform various algorithms. Such programs or instructions executed by the processor(s) 74 may be stored in any suitable article of manufacture that includes one or more tangible, computer-readable media at least collectively storing the instructions or routines, such as the memory 72. Additionally, the computing system 70 may include a display 76 may be a liquid crystal display (LCD) or other type of display that allows users to view images generated by the computing system 70. The display 76 may include a touch screen, which may allow users to interact with a user interface of the computing system 70.

The computing system 70 may also include one or more input structures 78 (e.g., a keypad, mouse, touchpad, one or more switches, buttons, or the like) to allow a user to interact with the computing system 70, such as to start, control, or operate a GUI or applications running on the computing system 70. Additionally, the computing system 70 may include network interface 80 to allow the computing system 70 to interface with various other electronic devices. The network interface 80 may include a Bluetooth interface, a local area network (LAN) or wireless local area network (WLAN) interface, an Ethernet connection, or the like.

In some embodiments, the computing system 70 may further be coupled to one or more sensors 82, via, for example, the network interface 80. This connection may be physical or wireless. The sensors 82 may operate to monitor a drilling fluid system 84 that operates to transmit drilling fluid through the drill pipe 20. In some embodiments, the drilling fluid system 84 may include a drilling fluid pump (e.g., a mud pump) that operates to transmit a volume of drilling fluid to the well. Additionally, the drilling fluid system 84 may operate to transmit the drilling fluid at a particular pressure. Accordingly, in some embodiments, the sensors 82 may operate as drilling fluid pump condition monitoring sensors (e.g., a pressure sensor and a fluid flow sensor) that detect a volume of drilling fluid being transmitted as well as a pressure of drilling fluid being transmitted from the drilling fluid system 84. The sensors 82 may monitor these attributes of the drilling fluid system 84 and may generate signals indicative of the volume of fluid being transmitted as well as a pressure of fluid being transmitted from the drilling fluid system 84 and may transmit these signals to the computing system 70 (e.g., via the network interface 80).

The computing system 70 may receive the indications from the sensors 82. In some embodiments, the computing system 70, utilizing programs or instructions executed by the processor(s) 74 that may be stored in any suitable article of manufacture that includes one or more tangible, computer-readable media at least collectively storing the instructions or routines, such as the memory 72, may correlate the received signals. For example, the processor 74 may operate to receive each of the signals and generate a secondary indication of a relationship therebetween (e.g., a correlation representation tying the currently received indication of the pressure of the drilling fluid to the volume of the drilling fluid transmitted). This correlated result may be saved by the computing system 70, for example, in memory 72. Additionally, the computing system 70 may continue to receive the indications from the sensors 82 indicative of pressure and volume of the drilling fluid and may repeat the correlation and recordation process described above.

Once a predetermined number of correlated results have been generated by the computing system 70, the computing system 70 may generate a set of ranges corresponding to the correlated results. The computing system 70 can then generated new correlated results based on newly received indications from the sensors 82 and the computing system 70 can compare the newly generated results to the generated ranges to determine whether the newly generated results fall within the ranges previously generated (e.g., indicating that the newly generated results are within normal operating parameters). If the newly generated results fall within the generated ranges, the computing system 70 can either disregard the newly generated results or, alternatively, utilize the newly generated results as a new data point for the an updated generated set of ranges.

If, however, the computing system 70 determines that the newly generated results do not fall within the generated ranges, the computing system 70 can operate to generate an indication of a warning, generate an alarm condition, and/or cause an automated BOP control signal to be generated to cause the BOP 16 to shut in the well. That is, if the computing system 70 determines that the newly generated results do not fall within the generated ranges, this result may be indicative of an influx as a precursor to a kick. In this manner, the computing system 70, operates as an early kick detection system.

In other embodiments, the computing system 70 may operate to include one or more threshold levels within the determined ranges that can be set at a level less than that of the determined range (e.g., within 5%, 10%, 15% of an upper or lower boundary of the determined ranges). If the computing system 70 determines that the newly generated results exceed the threshold levels within the generated ranges, the computing system 70 can operate to generate an indication of a warning, generate an alarm condition, and/or cause an automated BOP control signal to be generated to cause the BOP 16 to shut in the well (e.g., by the computing system 70 interfacing with the surface BOP control system 68 to cause a shut in signal to be generated). In this manner the computing system 70 may be considered an automatic well control system and/or the computing system 70 in conjunction with one or more of the sensors 82 and the surface BOP control system 68 may considered to be an automatic well control system.

Likewise, the computing system 70 may operate to collect the most recent 5, 10, 15, 20, or another number of newly generated results and determine whether the collected results are trending towards either one of the thresholds or the boundary of the determined ranges. When such a situation occurs, the computing system 70 can operate to generate an indication of a warning, generate an alarm condition, and/or cause an automated BOP control signal to be generated to cause the BOP 16 to shut in the well. Additionally, for any warnings or alarms generated by the computing system 70, visual, audio, or other indications may be tailored to the particular fault detected. For example, unique visual indication may be generated for display on the display 76 for each of the faults described above. Additionally or alternatively, color coded or other visual warnings may be issued (e.g., green for normal, yellow for a potential issue, and red for a fault) to indicate the severity of any deviations from the determined ranges by a newly generated result.

Figure 4:
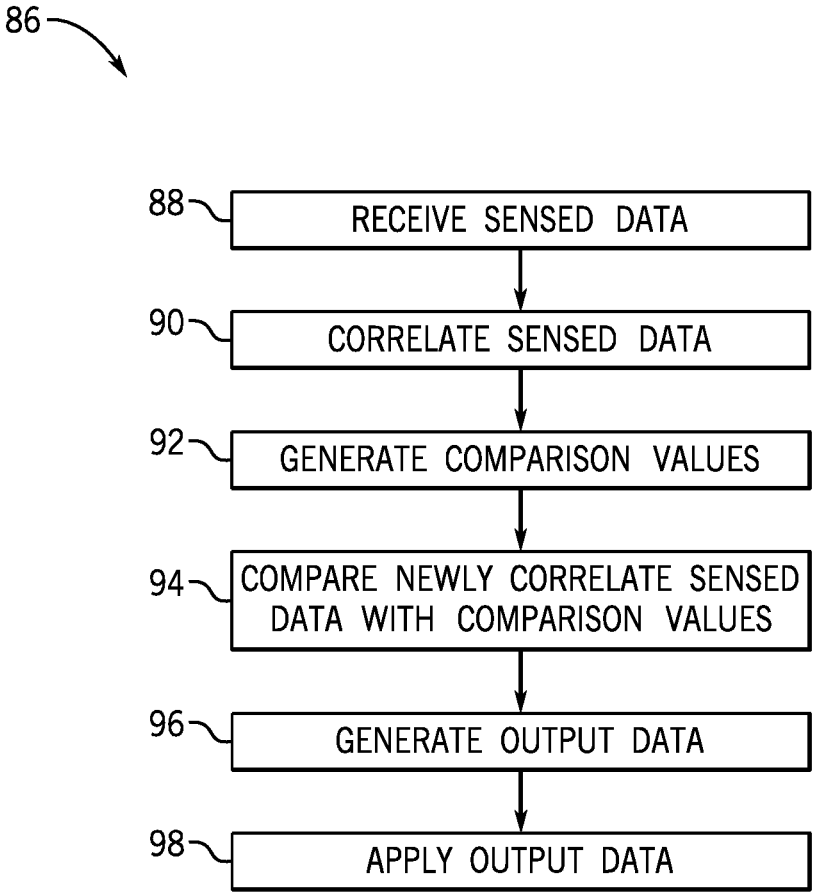
FIG. 4 illustrates a flow chart used in conjunction with the automatic well control system of FIG. 3, in accordance with an embodiment.

FIG. 4 illustrates a flow chart 86 illustrating the above noted operations of an automatic well control system (e.g., inclusive of the computing system 70 or the computing system 70 in conjunction with one or more of the sensors 82 and the surface BOP control system 68). In step 88, the computing system 70 may receive the sensed data relating to drilling fluid pump conditions (e.g., a volume of drilling fluid being transmitted as well as a pressure of drilling fluid being transmitted from the drilling fluid system 84). In step 90, the computing system 70 may generate a secondary indication of a relationship between the received sensed data in step 88 (e.g., a correlation representation tying the currently received indication of the pressure of the drilling fluid to the volume of the drilling fluid transmitted). In step 92, the computing system 70 may generate a set of ranges corresponding to the correlated results as comparison values. These correlated results may be considered baseline values (e.g., indicative of a characteristic of a well such as the lack of influx in the well) and may be used for subsequent comparisons to determine if future correlated results approximate the baseline values. For example, the correlated results may be values forming a range to which newly generated correlated results may be compared in step 94 to determine whether the newly generated results fall within the ranges previously generated (e.g., indicating that the newly generated results are within normal operating parameters). If the newly generated results fall within the generated ranges, the computing system 70 can either disregard the newly generated results or, alternatively, utilize the newly generated results as a new data point for the an updated generated set of ranges.

If, however, the computing system 70 determines that the newly generated results do not fall within the generated ranges, the computing system 70 can operate to generate an indication of a warning, generate an alarm condition, and/or cause an automated BOP control signal to be generated to cause the BOP 16 to shut in the well as output data in step 96. That is, if the computing system 70 determines that the newly generated results do not fall within the generated ranges, this result may be indicative of an influx as a precursor to a kick and output data to generate an action in response to this determination is performed in step 96. Thereafter, in step 98, the output data may be applied, for example, to generate a warning, generate an alarm condition, and/or cause an automated BOP control signal to be generated to cause the BOP 16 to shut in the well.

This written description uses examples to disclose the above description to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A system, comprising:

a first sensor configured to monitor a first characteristic of a drilling fluid and generate a first indication based on monitoring of the first characteristic;

a second sensor configured to monitor a second characteristic of the drilling fluid and generate a second indication based on monitoring of the second characteristic; and a processor configured to:

correlate the first indication with the second indication to generate a correlated result tying the first indication to the second indication as a baseline value indicative of a characteristic of a well; and generate a range of values based on the baseline value, wherein the range of values are utilized in a subsequent comparison to determine whether a future correlated result falls within the range of values as indicative of whether a change in the characteristic of the well has occurred as a precursor to an unplanned well event.

2. The system of claim 1, wherein the first sensor comprises a fluid flow sensor.

3. The system of claim 2, wherein the fluid flow sensor is configured to monitor a volume of the drilling fluid being transmitted into the well as the first characteristic.

4. The system of claim 1, wherein the second sensor comprises a pressure sensor.

5. The system of claim 1, wherein the second sensor is configured to monitor a pressure of the drilling fluid being transmitted into the well as the second characteristic.

6. The system of claim 1, wherein the first sensor is configured to generate a third indication, wherein the second sensor is configured to generate a fourth indication, wherein the processor is configured to correlate the third indication with the fourth indication to generate a second correlated result as the future correlated result.

7. The system of claim 6, wherein the processor is configured to determine whether the second correlated result has a value within the range of values.

8. The system of claim 7, wherein the processor is configured to adjust the range of values based on the second correlated result when the value is within the range of values.

9. The system of claim 7, wherein the processor is configured to generate an alarm when the value is outside of the range of values as indicative of the change of the characteristic of the well as the precursor to the unplanned well event.

10. The system of claim 7, wherein the processor is configured to generate an indication to initiate a shut in of the well via a BOP when the value is outside of the range of values as indicative of the change of the characteristic of the well as the precursor to the unplanned well event.

11. A device, comprising:

a processor configured to:

receive a first signal related to a first characteristic of a drilling fluid;

receive a second signal related to a second characteristic of the drilling fluid;

correlate the first signal with the second signal to generate a correlated result tying the first indication to the second indication;

compare the correlated result to a baseline value indicative of a characteristic of a well; and generate an indication of whether a change of the characteristic of the well has occurred as a precursor to an unplanned well event based on comparing the correlated result to the baseline value.

12. The device of claim 11, wherein the processor is configured to compare the correlated result to a range of values as the baseline value.

13. The device of claim 12, wherein the processor is configured to determine whether the correlated result has a value within the range of values.

14. The device of claim 13, wherein the processor is configured to adjust the range of values based on the correlated result when the value is within the range of values.

15. The device of claim 13, wherein the processor is configured to generate an alarm as the indication when the value is outside of the range of values.

16. The device of claim 13, wherein the processor is configured to transmit the indication to cause a BOP to shut in the well when the value is outside of the range of values.

17. A tangible, non-transitory computer-readable medium having computer executable code stored thereon, the computer executable code comprising instructions to cause a processor to:

receive a first signal related to a first characteristic of a drilling fluid;

receive a second signal related to a second characteristic of the drilling fluid;

correlate the first signal with the second signal to generate a correlated result tying the first indication to the second indication as a baseline value indicative of a characteristic of a well; and generate a range of values based on the baseline value, wherein the range of values are utilized in a subsequent comparison to determine whether a future correlated result falls within the range of values as indicative of whether a change in the characteristic of the well has occurred as a precursor to an unplanned well event.

18. The tangible, non-transitory computer-readable medium of claim 17, wherein the computer executable code comprises instructions to cause the processor to:

receive a third signal related to the first characteristic of the drilling fluid;

receive a fourth signal related to the second characteristic of the drilling fluid;

correlate the third signal with the fourth signal to generate a second correlated result as the future correlated result; and determine whether the second correlated result has a value within the range of values generated based about the baseline value.

19. The tangible, non-transitory computer-readable medium of claim 18, wherein the computer executable code comprises instructions to cause the processor to generate an indication of whether the change in the characteristic of the well has occurred as a precursor to an unplanned well event based on determining whether the second correlated result has a value within the range of values.

* * * * *